US005492636A

United States Patent [19]

Ansari et al.

[11] Patent Number: 5,492,636

[45] Date of Patent: Feb. 20, 1996

[54] CLEAR CONCENTRATED FABRIC SOFTENER

[75] Inventors: H. Rahman Ansari, Old Tappan; Lynda Rodriguez, Lake Hopatcong, both of N.J.; Barbara Potts, Milford, Pa.; Allan Streit, Sparta, N.J.

[73] Assignee: Quest International Fragrances Company, Mount Olive, N.J.

[21] Appl. No.: 309,497

[22] Filed: Sep. 23, 1994

[51] Int. Cl.[6] ..... D06M 13/322

[52] U.S. Cl. ..... 252/8.6; 252/8.8

[58] Field of Search ..... 252/8.6, 8.7, 8.75, 252/8.8, 8.9

[56] References Cited

U.S. PATENT DOCUMENTS

| | | | |
|---|---|---|---|
| Re. 34,062 | 9/1992 | Wells | 252/8.6 |
| 3,887,476 | 6/1975 | McConnell | 252/8.75 |
| 3,892,669 | 7/1975 | Rapisarda et al. | 252/8.75 |
| 3,897,348 | 7/1975 | Atkinson | 252/8.8 |
| 3,976,581 | 8/1976 | Rose | 252/8.8 |
| 4,202,800 | 5/1980 | Ciko et al. | 252/543 |
| 4,308,024 | 12/1981 | Wells | 252/8.6 |
| 4,569,800 | 2/1986 | Stanley et al. | 252/8.8 |
| 4,675,118 | 6/1987 | Stanley et al. | 252/8.8 |
| 4,751,009 | 6/1988 | Damaso et al. | 252/8.75 |
| 4,888,119 | 12/1989 | Klewsaat | 252/8.75 |

*Primary Examiner*—Anthony Green
*Attorney, Agent, or Firm*—Cushman Darby & Cushman

[57] ABSTRACT

A fabric softener composition consisting essentially of 5–35% by weight of an active fabric softening agent, 10–25% by weight of butyl carbitol, an effective amount of a fragrance and the balance essentially water, the ratio of butyl carbitol to active softening agent being such that the composition is a clear, free-flowing liquid.

7 Claims, No Drawings

CLEAR CONCENTRATED FABRIC SOFTENER

The present invention is concerned with a fabric softener composition.

BACKGROUND OF THE INVENTION

In recent years, fabric softening has become an integral part of the home laundry routine. Many different composition and use varieties have been proposed over the past twenty years or so. Some of the more recent trends include the "clear" craze characterized by concentrated, reduced packaging products.

A wide variety of fabric softening agents have been described in the patent literature. For example, JP 3033271 (Kao) discloses a transparent water-based softening agent having an antistatic effect. The agent comprises 12–35% wt. of a water-insoluble cationic textile-softener and 1–8 wt. % of (poly)oxyalkylene Guerbet alcohol branched monohydric alcohol. The softening agent is used for household treatment of clothing to give an antistatic effect and to restore softness.

JP 2300381 (Kao) describes a softening finishing agent for clothes which is practically transparent and contains 12–25 wt. % of a cationic softening base agent, 1–10 wt. % of an oil liquid substance having more than one ester bond and more than one hydroxyl group in the molecule, and having a viscosity of 20–2,000 cps. at 20° C., and 1–5 wt. % of a polyether compound, or derivative, of polychain type with av. mol. wt. 5,000– 2,000,000 and which is an alkylene oxide adduct of a compound having more than three active hydrogens as the essential components.

U.S. Pat. No. 3,892,669 (Unilever) discloses a clear fabric softening composition containing 2–20% wt. of a solubilized tetraalkyl quaternary ammonium salt having two short and two long chain alkyl groups. Apart from being visually clear, the composition is physically stable and remains clear when diluted, or after being subjected to a temperature range of 0°–125° F. The composition also imparts a soft and pleasing handle to fabrics which would otherwise tend to be harsh and stiff.

EP 82457 (Hoechst) refers to a clear liquid fabric softener concentrate comprising 26–40 wt. % of a cationic fabric softener (I), 0.01–8 wt. % of an anionic surfactant (II), 0.01–8 wt. % of a nonionic dispersant (III), 3–30 wt. % of 1–3 C alkanol (IV) and the balance being water and optional perfumes, colorants and other additives. The softener (I) is especially a quaternary ammonium salt or an imidazolinium salt. Component (II) is preferably of formula $Me(CH_2)_nCH(SO_3Y)CH_2Me$, $ArSO_3Y$, $R_5O(CH_2CH_2O)_mSO_3Y$ or $R_6CH{=}CHCH_2SO_3Y$ where n is 11–14; Ar is p-$R_4$-phenyl; $R_4$–$R_6$ are 10–15 C alkyl; m= 0–5; Y is Na, K or $NH_4$. Component (III) is preferably an ethoxylated alkylphenol or fatty alcohol. The compositions have good storage stability, exhibiting no thickening or solids precipitation on standing for long periods.

U.S. Pat. No. 3,887,476 (Ashland Oil Inc.) describes a fabric softener concentrate dispersion containing 65–85 wt. % of a quaternary ammonium salt and 35–15 wt. % of a lower alkanol.

EP 435476 (Hoechst) refers to laundry soft-rinsing concentrates consisting by weight of 30–70% cationic softener, 5–50% nonionic softener, 5–20% nonionic dispersant, 5–30% 1–3 C alkanol, 5–30% liquid glycol, polyglycol or alkyl ether thereof, water and optional perfume and dyestuffs, up to 100%. The concentrates are easily dispersed in cold water without gel formation.

U.S. Pat. No. 4,751,009 (Akzo) discloses a clear, stable, single phase fabric softener containing by weight 10–16% anionic surfactant (containing an at least 8 C alkyl), 20–35% cationic surfactant, 15–25% propylene glycol, 8–10% of an alkali metal sulphonate, and not more than 30% $H_2O$.

Notwithstanding prior efforts, as represented by the foregoing, there is still a need for liquid fabric softening compositions which demonstrate improved softening effects and/or other desirable properties, e.g. increased shelf-life and ease of pourability.

SUMMARY OF THE INVENTION

The invention provides a highly concentrated, stable, crystal-clear fabric softener composition. The composition is a clear, i.e. transparent, low viscosity, easily pourable, concentrated product based on the use of one or more quaternary ammonium or imidazolinium salts or the equivalent as active softening component together with butyl carbitol and water. The product advantageously does not include alcohols or other VOC solvents (i.e. low molecular weight glycol ethers) although in some cases, a small amount of hexylene glycol or the equivalent may be included with some reduction in the overall quality of the product. Preferably, however, butyl carbitol is the sole organic vehicle.

The product of the invention has been found to maintain a high level of fabric softening combined with desirable fragrance and deposition, aesthetics and shelf-life under a wide variety of conditions, for example, storage at −15° C. to 55° C. over periods of 4 to 12 weeks or even more.

Broadly described, the fabric softener composition of the invention is a clear, low viscosity, pourable liquid composition which consists essentially of from 5–35%, preferably 10–35%, by weight of one or more active softening components such as quaternary ammonium or imidazolinium salts, from 10–25% by weight of butyl carbitol and the balance essentially water, preferably with an effective amount (e.g. up to 2% by weight) of a fragrance and optionally other additives employed for special effects which do not negatively impact on the softening action of the active ingredient(s).

DETAILED DESCRIPTION OF THE INVENTION

Butyl carbitol is essential to the compositions of the invention. Thus, it has been found that the results obtained using butyl carbitol cannot be realized if the butyl carbitol is replaced by some other glycol ether.

The amount of butyl carbitol may be varied but, as indicated, should be within the range of about 10–25% by weight of the formulation. The ratio of butyl carbitol to active softening component(s) is also critical to obtain a clear, free-flowing liquid of low viscosity (e.g. about 10–30 centipoises at 25° C.) suitable for use as a fabric softener. This ratio can be varied somewhat depending on the active ingredient(s) used but should be within the range of about 2:1 to 0.5:1 butyl carbitol to active ingredient(s), on a weight basis.

One or more active softening ingredients may be used in the present compositions. Suitable softening components for use herein include the softening agents referred to in the prior patent disclosures referred to in the foregoing, e.g. the quaternary ammonium salts or imidazolinium salts referred to in U.S. Pat. No. 3,892,669 and EP 82457. Representative examples of suitable fabric softening agents suitable for use as the active ingredient(s) are listed below by general chemical category with specific examples being given for each class:

Quaternary Ammonium Salts

Dihydrogenated tallow dimethyl ammonium chloride

Dicoco dimethyl ammonium chloride

Dimethyl dialkyl(C-12 to C-18) ammonium chloride (Varisoft 432 PPG)

Imidazolinium Salts

Methyl-1-tallow amidoethyl-2-tallow imidazolinium methosulfate

Methyl-1-oleyl amidoethyl-2-oleyl imidazolinium methosulfate (Varisoft 3690 PG)

Others

Varisoft DS-100, a proprietary blend of fabric softener actives marketed by SHEREX Company.

While various actives mentioned above can be used with a certain degree of manipulation of solvent to the active ratio within the stated range of the invention, the system is nevertheless extremely sensitive to any variation in the molecular structure of the softener actives. Therefore, it has been found that the most preferred active ingredients used herein are dimethyl dialkyl (C-12 to C-18) ammonium chloride and methyl-1-oleyl amidoethyl-2-oleyl imidazolinium methosulfate.

The amount of fabric softening agent will vary to some extent depending on the particular ingredients which may be used. However, for present purposes, the amount should not exceed 5–35%, preferably 10–35%, by weight of the total composition.

Any conventional or available fragrance or fragrance ingredient may be used for present purposes provided these are consistent with the objects of the invention. As representative fragrances, and fragrance ingredients there may be mentioned natural products such as essential oils, absolutes, resinoids, resins, concretes, etc., and synthetic perfume components such as hydrocarbons, alcohols, aldehydes, ketones, ethers, acids, esters, acetals, ketals, nitriles, etc., including saturated and unsaturated components, aliphatic, carbocyclic and heterocyclic compounds. Examples of such perfume components are: geraniol, geranyl acetate, linalool, linalyl acetate, tetrahydrolinalool, citronellol, citronellyl acetate, dihydromyrcenol, dihydromyrcenyl acetate, tetrahydromyrcenol, terpineol, terpinyl acetate, nopol, nopyl acetate, 2-phenylethanol, 2-phenylethyl acetate, benzyl alcohol, benzyl acetate, benzyl salicylate, benzyl benzoate, styrallyl acetate, amyl salicylate, dimethylbenzyl carbinol, trichloromethylphenylcarbinyl acetate, p-tert.butyl-cyclohexyl acetate, isononyl acetate, vetiveryl acetate, vetiverol, alpha-n-amylcinammic aidehyde, alphah-hexylcinammic aidehyde, 2-methyl-3-(p-tert.butylphenyl)-propanol, 2-methyl-3-(p-isopropylphenyl)-propanal, 3-(p-tert.butylphenyl)-propanal, tricyclodecenyl acetate, tricyclodecenyl propionate, 4-(4-hydroxy- 4-methylpentyl)-3-cyclohexene carbaldehyde, 4-(4-methyl-3-pentenyl)-3-cyclohexene carbaldehyde, 4-acetoxy-3-pentyletetrahydropyran, methyl-dihydrojasmonate, 2-n-heptylcyclopentanone, 3-methyl-2-pentylcyclopentanone, n-decanal, 9-decenol-1, pehoxyethyl isobutyrate, phenylacetaldehyde dimethyl acetal, phenylacetaldehyde diethyl acetal, geranonitrile, citronellonitrile, cedryl acetate, 3-isocamphycyclohexanol, cedryl methyl ether, isolongifolanone, aubepine nitrile, aubepine, heliotropine, coumarin, eugenol, vanillin, diphenyl oxide, hydroxycitronellal, ionones, methylionones, isomethylioniones, irones, cis-3-hexenol and esters thereof, indane musk fragrances, tetralin musk fragrances, isochroman musk fragrances, macrocyclic ketones, macrolactone musk fragrances, ethylene brassylate, aromatic nitro-musk fragrances.

Especially preferred perfume components include bergamot oil, coriander oil, dimethyl heptanol, dimethyl benzyl carbinyl acetate, geranyl acetate, citronellyl acetate, rose synthetic, geranium bourbon, hedione, iso eugenol, methyl eugenol styrallyl acetate, stemone, rose oxide laevo, aldehyde C-11 undecyclic, derivatives of 2,6-dimethyl-2-alkoxy octan-7-ol, vertivert oil, vetiverol, vetiveryl, acetate, quaiac wood oil, esters ol-anthranilic acid, benzyl salicylate, benzyl benzoate, oak moss, eugenol, p-tert-butyl cyclohexyl acetate, coumarin.

The amount of fragrance can be varied as desired. Usually, however, a sufficient and effective amount is from 0.5 to 2% by weight of the composition.

The amount of water used in the present compositions will also vary over a fairly wide range. Normally, however, the composition will include at least about 40% by weight of water but not more than about 75% thereof. The amount of water may be adjusted to optimize the viscosity of the formulation provided the required ratio of butyl carbitol to active component is maintained.

As noted, other additives may also be included in the Composition of the invention provided they do not conflict with the objects and purposes of the invention to provide a clear liquid, free-flowing formulation. Such optional additives may include:

Dyes, optical brighteners and softening aids such as Aloe Vera gel. The addition of trace amounts of dye or optical brightener in particular can be used in some cases where the composition might be clear but otherwise have a pale yellow tinge to provide a water-white appearance to the product. Of particular value are trace amounts of external D&C violet #2 and fluorescent coral.

The invention is illustrated, but not limited, by the following examples:

EXAMPLE 1

The following materials were mixed together in the amounts indicated:

| | % by Weight |
|---|---|
| Varisoft 432 PPG | 22.00 |
| Varisoft 3690 PG | 17.55 |
| Butyl Carbitol | 18.20 |
| Fragrance | 1.70 |
| Distilled Water | 40.55 |

The resulting composition was a crystal-clear liquid with low viscosity (10–30 cps at 25° C.). The composition contains no VOCs as defined by the California Air Resources Board.

When used in conventional fashion for washing a load of clothes, it was found that the composition contributed substantially to the softening and fragrance impact of a standard (ASTM) washload at a relatively low dosage of 20 ml.

The composition, containing a nearly 40% dual active system (Varisoft 432 and Varisoft 3690), was also found to be stable after multiple freeze/thaw cycles and extended time periods under temperatures ranging from −15° C. to 45° C.

Varisoft 432 PPG, as noted above, is a dimethyl difatty ammonium chloride wherein the fatty substituents are dialkyl groups with C-12 to C-18 chain length.

Varisoft 3690 PG, also as noted, is a 1-methyl- 1-alkyl-amidoethyl-2-alkyl-imidazolinium methosulfate wherein both the 1-alkyl and 2-alkyl are oleyl.

Butyl carbitol, as those in the art will know, may also be described as diethylene glycol monobutyl ether.

The fragrance used in the above example was a fresh, floral blend with musky background although it will be recognized that other equivalent fragrances may be used.

EXAMPLE 2

The following compositions A–H were prepared as in Example 1 but using, in each case, only a single active softening component:

| | % by Weight | | | | | | | |
|---|---|---|---|---|---|---|---|---|
| | A | B | C | D | E | F | G | H |
| Varisoft 3960 PG | 33.5 | 22.2 | 22.2 | 11.1 | 11.1 | 11.1 | 22.2 | 33.5 |
| Butyl Carbitol | 18.2 | 10.3 | 19.2 | 19.2 | 10.3 | 14.3 | — | 20.2 |
| Carbitol | — | — | — | — | — | 19.2 | — | |
| Fragrance | 1.7 | 1.5 | 1.5 | 1.0 | 1.0 | 1.0 | 1.5 | 1.7 |
| Water | 46.6 | 66.0 | 57.1 | 68.7 | 77.6 | 73.6 | 57.1 | 44.6 |
| Clarity | cloudy | clear | clear | clear | cloudy | clear | clear | clear |
| Form | liquid | gel | liquid | liquid | liquid | liquid | gel | liquid |

Compositions C, D, F and H, which were both clear and liquid, represent formulations according to the invention. These formulations are characterized by a butyl carbitol content of at least about 14% by weight, an active ingredient(s) content of at least about 11% and a butyl carbitol to active component ratio in the range of about 2:1 to 0.5:1.

EXAMPLE 3

The following further compositions according to the invention were prepared as in Example 1:

| | % wt. | |
|---|---|---|
| | I | J |
| Varisoft 3960 PG | 33.5 | 11.1 |
| Butyl Carbitol | 19.2 | 14.3 |
| Fragrance | 1.7 | 1.0 |
| Distilled Water | 45.6 | 73.6 |

Compositions I and J were clear, free-flowing liquids with viscosity in the range of 10–30 centipoises at 25° C.

It will be appreciated from the foregoing that various modifications may be made in the invention as described above without departing from the scope thereof. For example, while the compositions have been described as suitable for use as fabric softeners, these compositions may also be prepared for use as other household products or for personal products such as shampoos. Accordingly, the scope of the invention is defined in the following claims.

What is claimed is:

1. A fabric softener composition consisting essentially of 5–35% by weight of at least one active fabric softening agent selected from the group consisting of a quaternary ammonium chloride and an imidazolinium salt, 10–25% by weight of butyl carbitol, a fragrance-providing amount of a fragrance and the balance essentially water, the ratio of butyl carbitol to active softening agent being in the range of 2:1 to 0.5:1 such that the composition is a clear, free-flowing liquid.

2. The composition of claim 1 wherein the amount of active fabric softening agent is 10–35% by weight of the composition.

3. The composition of claim 1 which has a viscosity of 10–30 centipoises at 25° C.

4. The composition of claim 1 wherein the active fabric softening agent is a quaternary ammonium chloride.

5. The composition of claim 4 wherein the active fabric softening agent is a dimethyl dialkyl (C-12 to C-18) ammonium chloride.

6. The composition of claim 1 wherein the active fabric softening agent is a 1-methyl-1-oleyl-amidoethyl-2-oleylimidazolinium methosulfate.

7. The composition of claim 1 wherein said fabric softening agent is a mixture of a quaternary ammonium chloride and an imidazolinium salt.

* * * * *